US007690061B2

(12) United States Patent
Potyrailo et al.

(10) Patent No.: US 7,690,061 B2
(45) Date of Patent: Apr. 6, 2010

(54) METHOD AND APPARATUS FOR CONTROLLING A LAUNDERING PROCESS

(75) Inventors: Radislav Alexandrovich Potyrailo, Niskayuna, NY (US); Patrick Edward Pastecki, Albany, NY (US); Derek Lee Watkins, Elizabethtown, KY (US); Jeffrey Bernard Fortin, Niskayuna, NY (US); William Guy Morris, Rexford, NY (US)

(73) Assignee: General Electric Company, Niskayuna, NY (US)

( * ) Notice: Subject to any disclaimer, the term of this patent is extended or adjusted under 35 U.S.C. 154(b) by 1119 days.

(21) Appl. No.: 11/318,297

(22) Filed: Dec. 22, 2005

(65) Prior Publication Data

US 2007/0143933 A1 Jun. 28, 2007

(51) Int. Cl.
*D06F 33/02* (2006.01)

(52) U.S. Cl. ..... 8/158; 68/12.02

(58) Field of Classification Search ..... 68/12.02; 134/113; 8/158

See application file for complete search history.

(56) References Cited

U.S. PATENT DOCUMENTS

| | | | | | |
|---|---|---|---|---|---|
| 3,613,405 | A | * | 10/1971 | Shimokusu et al. | 68/12.02 |
| 4,222,250 | A | | 9/1980 | Torita | |
| 4,372,134 | A | | 2/1983 | Matsuo | |
| 4,906,101 | A | * | 3/1990 | Lin et al. | 356/442 |
| 5,134,867 | A | | 8/1992 | Kiuchi et al. | |
| 5,172,572 | A | * | 12/1992 | Ono | 68/12.02 |
| 5,370,743 | A | | 12/1994 | Usui et al. | |
| 5,373,714 | A | * | 12/1994 | Wada | 68/12.02 |
| 5,378,993 | A | | 1/1995 | Flask et al. | |
| 5,536,663 | A | * | 7/1996 | Mueller-Kirschbaum et al. | 436/55 |
| 6,836,332 | B2 | * | 12/2004 | Mosley et al. | 356/436 |
| 2004/0177680 | A1 | | 9/2004 | Skogo et al. | |

FOREIGN PATENT DOCUMENTS

| | | | | |
|---|---|---|---|---|
| DE | 29 49 254 | | * | 6/1981 |
| DE | 2949254 | A1 | | 6/1981 |
| DE | 4112417 | A1 | | 10/1992 |
| DE | 19626203 | | | 2/1998 |
| DE | 19740266 | A1 | | 3/1999 |
| DE | 19908803 | | | 7/2000 |
| DE | 10145601 | | | 10/2002 |
| DE | 10308198 | B3 | | 2/2003 |
| EP | 0393311 | | | 1/1990 |
| EP | 0653620 | | | 10/1994 |
| EP | 0992622 | | | 10/1999 |
| EP | 1452 850 | A1 | | 2/2004 |
| JP | 06-63279 | | * | 3/1994 |

* cited by examiner

*Primary Examiner*—Frankie L Stinson
(74) *Attorney, Agent, or Firm*—Richard D. Emery

(57) ABSTRACT

A method for controlling a laundering process includes determining a concentration of a detergent within a wash fluid during at least one cycle of an article laundering process, and dynamically adjusting at least one characteristic of the laundering process based at least in part upon the determined concentration of the detergent. An apparatus for controlling a laundering process includes a fluid chamber to contain a wash fluid, a sensor coupled to the fluid chamber to determine a detergent concentration within the wash fluid, and a controller coupled to the sensor and configured to dynamically adjust at least one characteristic of the laundering process based at least in part upon the determined detergent concentration.

24 Claims, 8 Drawing Sheets

METHOD AND APPARATUS FOR CONTROLLING A LAUNDERING PROCESS

BACKGROUND

The invention relates generally to article cleaning processes.

Conventional cleaning apparati such as washing machines utilize timed wash and rinse cycles as part of their laundering process. One problem with relying upon timed cycles is that at the end of a given cycle, clothing or other articles being laundered may not always be clean or detergent-free. In fact, due to variations in laundry load size and detergent usage amounts from one laundering cycle to another, it is very common for clothes to contain residual amounts of detergent even after all rinse cycles have been completed. The presence of the residual detergent can cause a variety of reactions in individuals ranging from minor itching to sever skin irritation in those who may be hypoallergenic.

In order to avoid the presence of residual detergents, many washing machine manufacturers unnecessarily program their rinse cycles for durations that are longer than which may otherwise be necessary. For example, even if the residual amounts of detergents contained within clothes fall below a predetermined acceptable level prior to the completion of the programmed rinse cycles, conventional washing machines nonetheless continue to complete the preprogrammed rinse cycles without modification. This is true even in the case where minimal to no additional detergent may be removed from the clothes through additional rinsing. Accordingly, this can result in a waste of natural resources such as energy and water as well as increased operating costs for the consumer.

BRIEF DESCRIPTION

In accordance with one aspect of the invention, a method for controlling a laundering process includes determining a concentration of a detergent within a wash fluid during at least one cycle of an article laundering process, and dynamically adjusting at least one characteristic of the laundering process based at least in part upon the determined concentration of the detergent.

In accordance with a second aspect of the invention, an apparatus for controlling a laundering process includes a fluid chamber to contain a wash fluid, a sensor coupled to the fluid chamber to determine a detergent concentration within the wash fluid, and a controller coupled to the sensor and configured to dynamically adjust at least one characteristic of the laundering process based at least in part upon the determined detergent concentration.

DRAWINGS

These and other features, aspects, and advantages of the present invention will become better understood when the following detailed description is read with reference to the accompanying drawings in which like characters represent like parts throughout the drawings, wherein.

Figure 9:
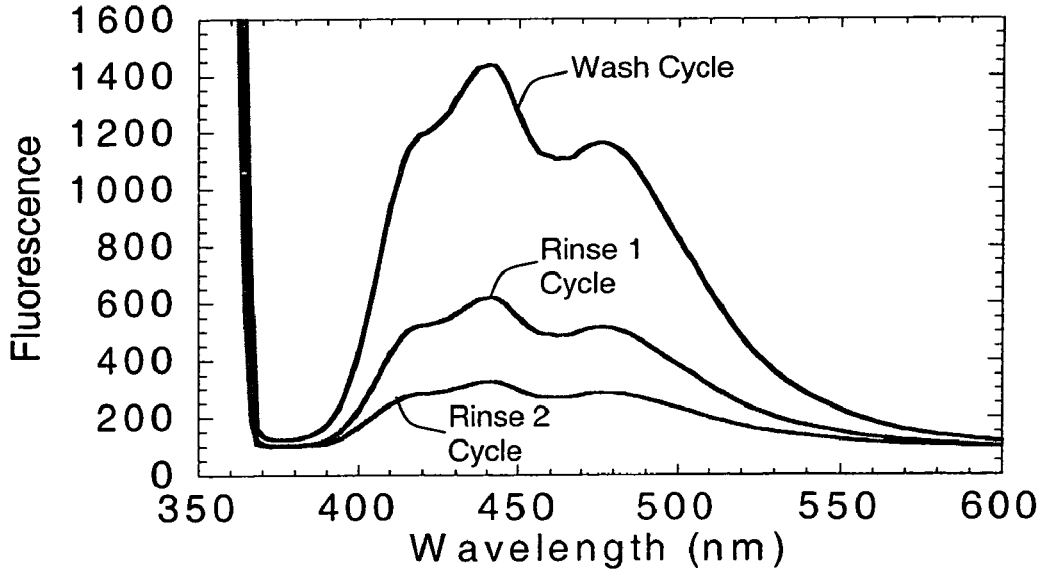
Figure 10:
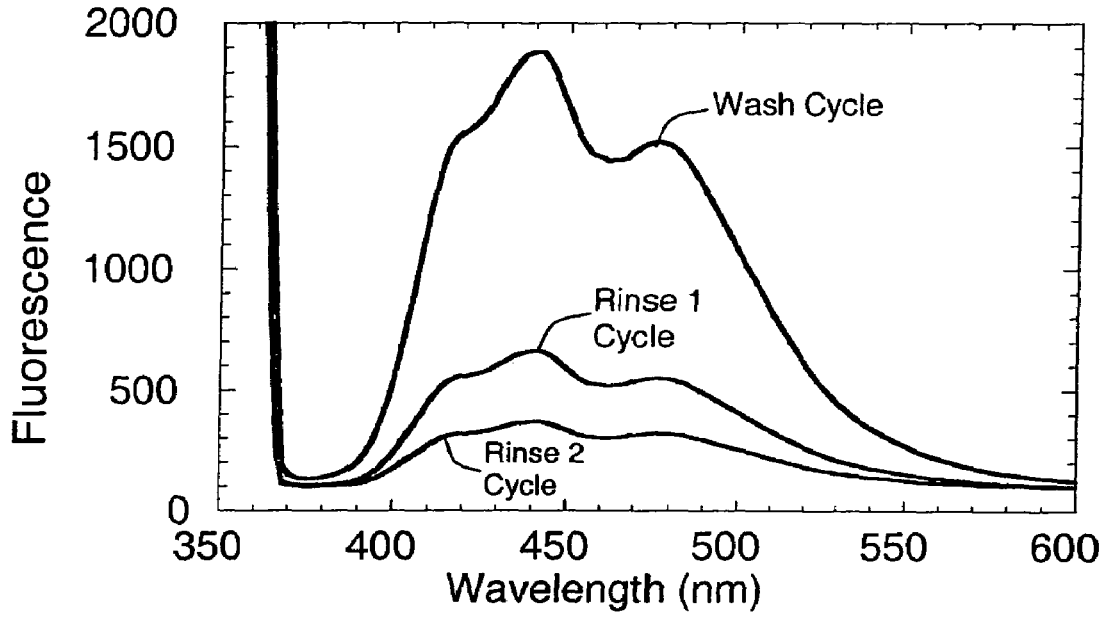
Figure 11:
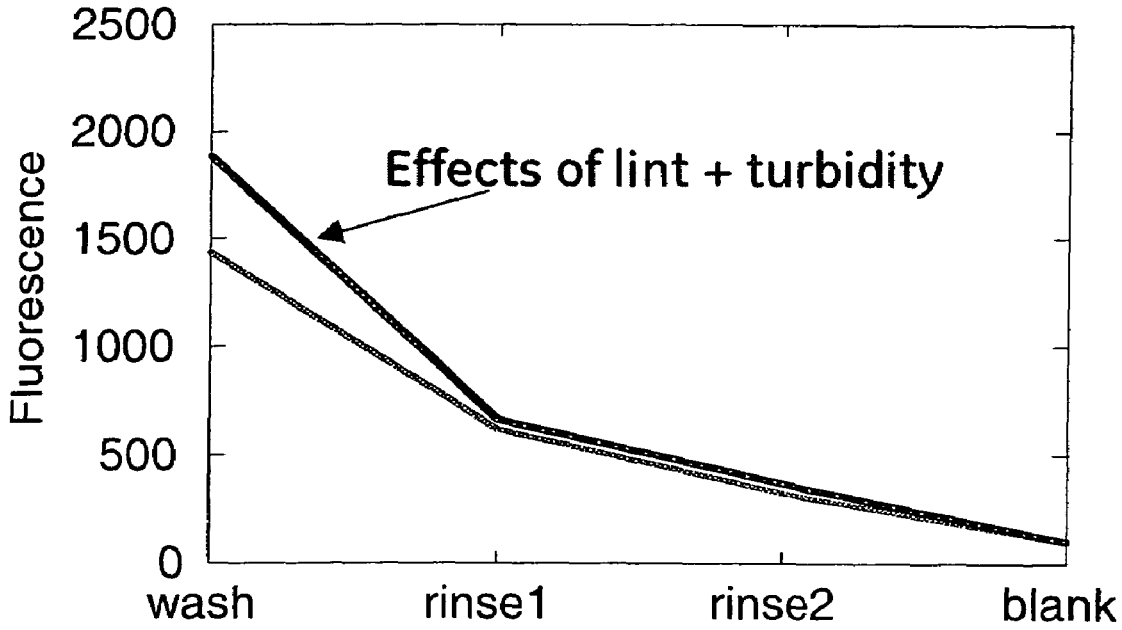
Figure 12:
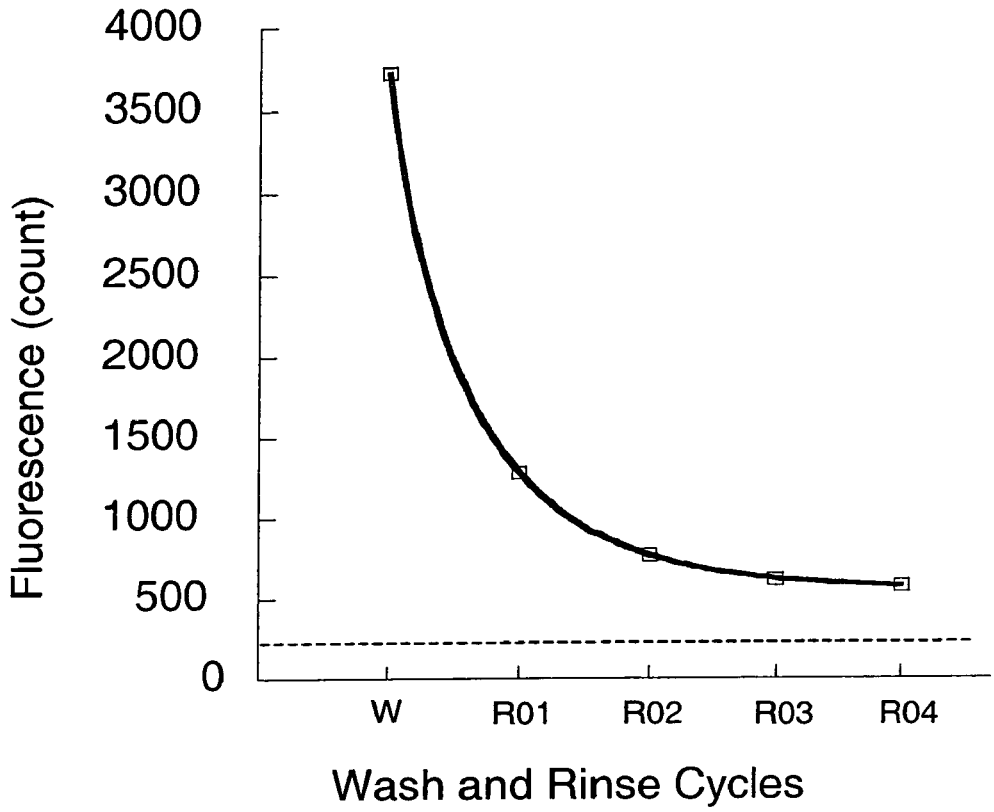
Figure 13:
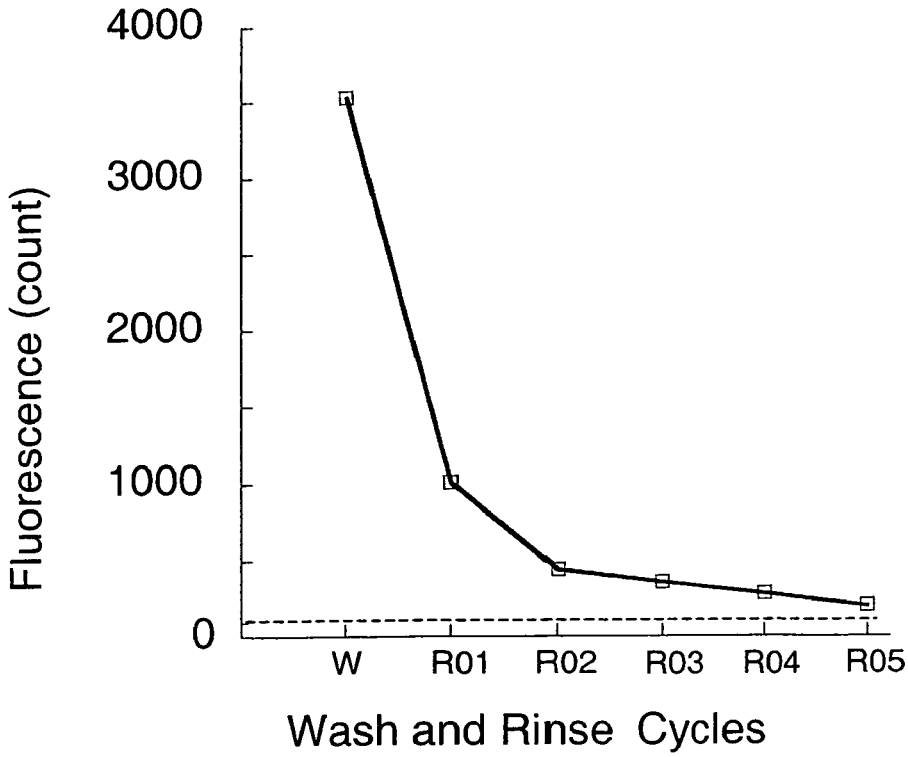
Figure 14:
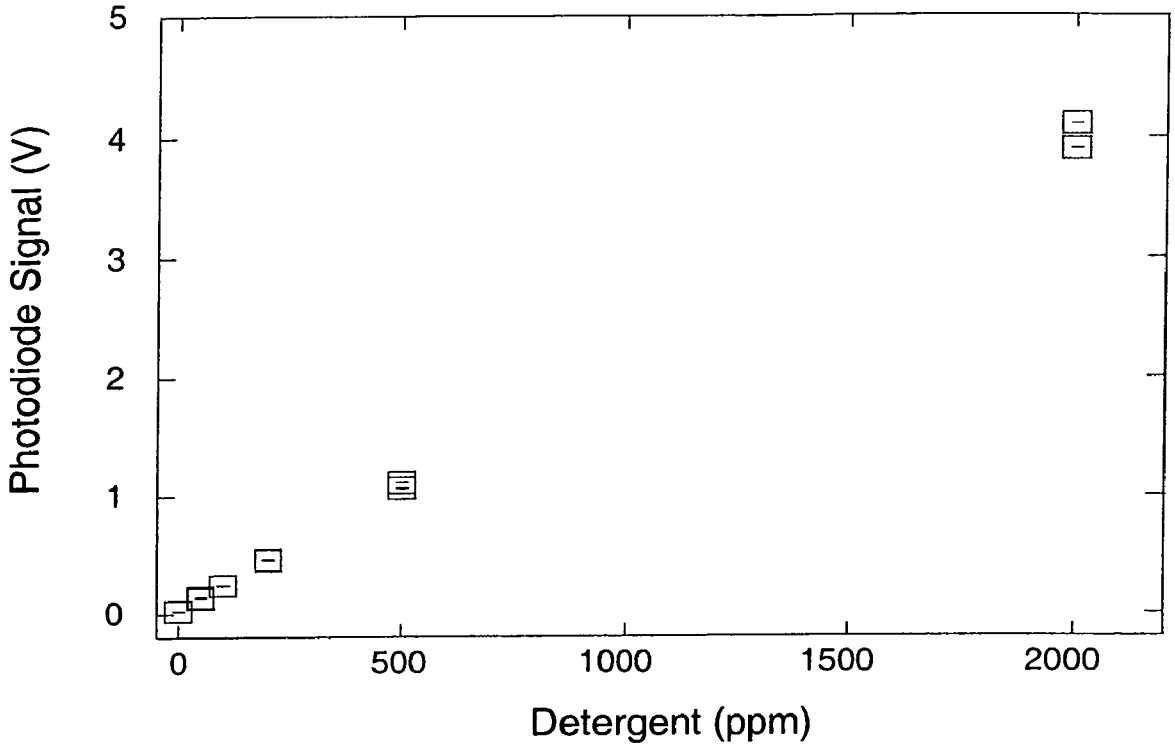

FIG. 9 and FIG. 10 demonstrate fluorescence spectra of water samples from a wash and two rinse cycles when a certain amount of lint was settled and unsettled;

FIG. 11 illustrates response curves produced by plotting fluorescence signals in a wash cycle and two rinse cycles;

FIG. 12 illustrates plots of fluorescence spectra of water samples from a vertical axis washing machine;

FIG. 13 illustrates plots of fluorescence spectra of water samples from a horizontal axis washing machine; and FIG. 14 illustrates a calibration curve for detergent concentrations, in accordance with one embodiment.

DETAILED DESCRIPTION

In the following detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. In other instances, well known methods, procedures, and components have not been described in detail.

Furthermore, various operations may be described as multiple discrete steps performed in a manner that is helpful for understanding embodiments of the present invention. However, the order of description should not be construed as to imply that these operations need be performed in the order they are presented, nor that they are even order dependent. Moreover, repeated usage of the phrase "in one embodiment" does not necessarily refer to the same embodiment, although it may. Lastly, the terms "comprising", "including", "having", and the like, as well as their inflected forms as used in the present application, are intended to be synonymous unless otherwise indicated.

As used herein, the term "laundering process" refers to an article cleaning process by which articles to be cleaned are exposed to one or more cleaning agents. The term "article" may refer to but need not be limited to fabrics, textiles, garments, and linens. Furthermore, the term "load" may include a mixture of different or similar articles of different or similar types and kinds of fabrics, textiles, garments and linens within a particular laundering process. The term "wash fluid" is intended to broadly refer to a liquid phase used during a wash cycle or rinse cycle of a laundering process to remove dirt, odors, detergents or other components that are non-native to the articles to be laundered. The term "wash cycle" is intended to refer to one or more periods of time, in which a laundering apparatus that contains the articles to be laundered operates using a detergent to e.g., remove dirt and odors from the articles. The term "rinse cycle" is intended to refer to one or more periods of time in which the laundering apparatus operates to remove residual detergents that were retained by the articles after completion of the wash cycle. During a wash cycle of a laundering process described herein, the wash fluid may be a mixture of one or more commonly available laundry detergents and water. Alternatively, the wash fluid may be plain water. However, due to the leaching of residual detergents from the articles during the progression of the rinse cycle, the wash fluid used in the rinse cycle may end up as a mixture of water and some amount of detergent.

As it can be appreciated, detergent concentrations in wash fluids of different wash and rinse cycles can vary greatly depending upon a number of factors including the amount of detergent used, the amount of wash fluid (including e.g., water and/or, additives) provided, the temperature of the wash fluid, and the composition of the articles and size of the load to be laundered. As such, the amount of water and number of rinse cycles necessary to remove all but an acceptable amount of residual detergent from the articles can vary greatly. Thus, in accordance with one aspect of the invention, the concentration of detergent contained within wash fluid of a laundering process may be determined and at least one characteristic of a laundering process may be dynamically adjusted based at least in part upon the determined detergent concentration. The detergent concentration may be determined during one or more wash or rinse cycles of a laundering process and further may be sensed continuously, periodically or at otherwise discrete intervals throughout the laundering process. The term "concentration" as used herein with respect to detergent is intended to refer to the amount of detergent per unit volume of wash fluid, typically measured in parts-per-million (PPM). Thus the greater the amount of detergent present within a fixed volume of wash fluid, the greater the detergent concentration will be.

Figure 1:
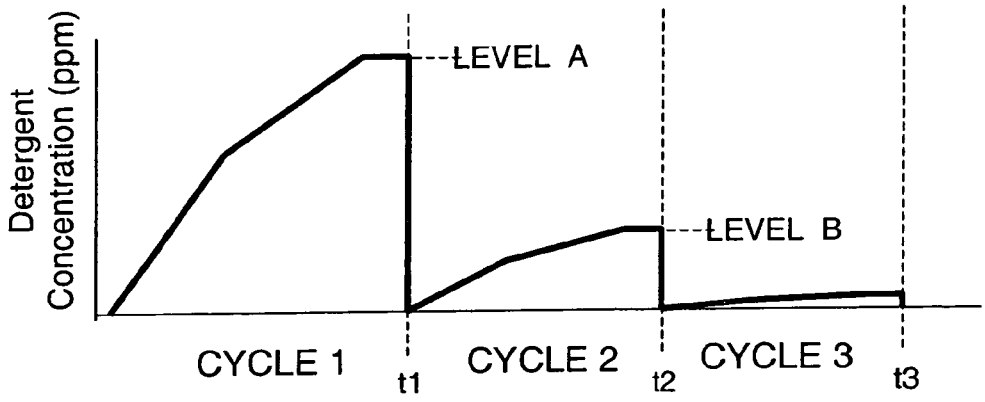
FIG. 1 illustrates a plot of detergent concentration versus time for three cycles of an example laundering process.

FIG. 1 illustrates a plot of detergent concentration versus time for three cycles of an example laundering process. More specifically, the plot of FIG. 1 is representative of detergent concentration of a laundering process during a wash cycle (CYCLE 1) and two subsequent rinse cycles (CYCLE 2 and CYCLE 3). With reference to FIG. 1, it can be seen that as CYCLE 1 progresses towards completion, the concentration level of the detergent increases rather rapidly. This is reflective of the initial detergent being added to the load and subsequently dissolved into the wash fluid. Once the detergent has substantially dissolved into the wash fluid, the detergent concentration tends to stabilize or level off (e.g., at LEVEL A) indicating that little or no additional detergent can be dissolved in the wash fluid. Once the wash cycle completes and the wash fluid is emptied from the associated laundering apparatus the detergent concentration can be shown to immediately decreases to zero at time t1. As described here, the concentration of the detergent increases from its minimal level to LEVEL A. This dynamic signature can occur when a device that measures detergent concentration in real time is positioned at a distance from the detergent dispenser. Alternatively, if a device that measures detergent concentration in real time is positioned close to the detergent dispenser, the initial concentration may be at a maximum and then decrease to and again stabilize at LEVEL A. In both cases, such a device that measures detergent concentration in real time may measure the detergent concentration level A and or dynamics of the signal that is approaching LEVEL A.

With the start of CYCLE 2, clean (e.g., non-detergent containing) wash fluid such as water is pumped into the laundering apparatus. As the clean wash fluid mixes with the articles being laundered, residual amounts of detergent retained by the articles from the wash cycle begin to leach out into the wash fluid. This in turn causes the detergent concentration in the wash fluid of the first rinse cycle to gradually increase until an equilibrium point is reached (LEVEL B) where the detergent concentration level remains substantially constant independent of the amount of time remaining in the current cycle. That is, at this point, only negligible amounts of additional detergent will be extracted from the articles without the addition of or replacement by clean wash fluid. As CYCLE 2 completes at time t2, the wash fluid is emptied from the laundering apparatus and the detergent concentration immediately decreases to zero. With the start of CYCLE 3, clean wash fluid is again pumped into the laundering apparatus causing additional amounts of detergent to be extracted from the articles and subsequently detected in the wash fluid. This continues until the laundering process ends and the wash fluid is evacuated one again at time t3.

Figure 2:
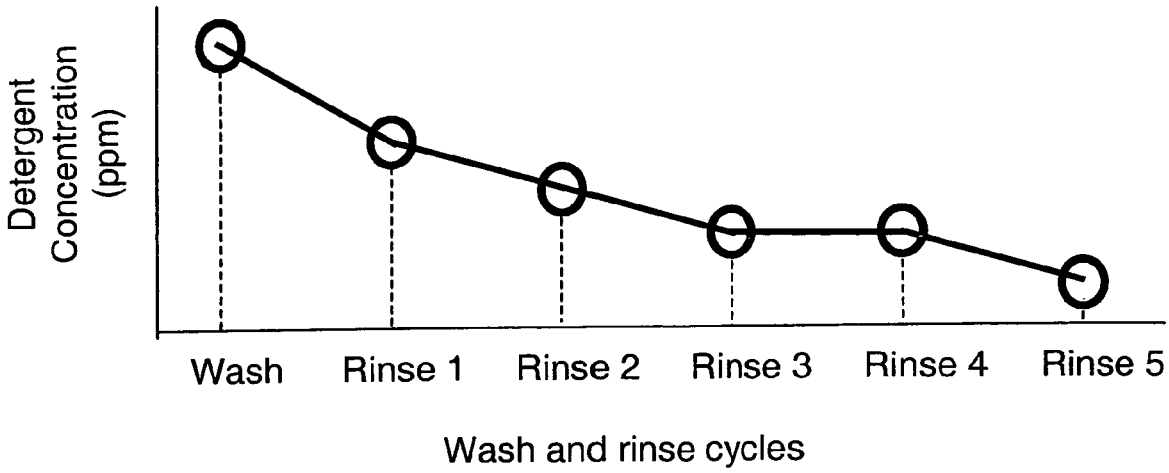
FIG. 2 illustrates a plot of maximum detergent concentration versus time for a wash cycle and four rinse cycles of an example laundering process.

Since the detergent that is detected in the wash fluid of each rinse cycle following a wash cycle is due to residual detergent leaching from the articles being laundered, the concentration of detergent in the rinse cycles should be less than that of the wash cycle. Additionally, the respective maximum concentrations of detected detergent should continue to decrease after each successive rinse cycle. FIG. 2 illustrates a plot of maximum detergent concentration versus time for a wash cycle and four rinse cycles of an example laundering process. With reference to FIG. 2, it can be seen that with the completion of each wash/rinse cycle, the maximum detergent concentration levels tend to decrease. This is an indication that the amount of residual detergent retained by the articles tends to decrease with the completion of each passing cycle. However, in the illustrated plot of FIG. 2, the detergent concentration is shown to remain substantially constant between rinse cycle 3 and rinse cycle 4. This is an indication that only insignificant amounts of additional detergent can be removed from the articles without an exchange of wash fluid. Any slight concentration increase in this case may be associated with the formation and detection of other species besides detergent (for example, lint, etc.) in the wash fluid. As such, the laundering process of FIG. 2 could otherwise have been stopped at the end of rinse cycle 3 rather than the end of rinse cycle 4 with no noticeable difference in the amount of residual detergent retained by the articles. This means an entire rinse cycle such as rinse cycle 4 in FIG. 2 could have been avoided resulting in time savings as well as water and energy savings. Furthermore, once it is determined that the detergent concentration has leveled-off or equalized for a given cycle, the cycle may be stopped before it is otherwise scheduled to end since further rinsing will only remove insubstantial amounts of detergent from the articles. It is important to note the equilibrium between the residual detergent concentration in the articles and that in the wash fluid as shown during rinse cycle 3 and rinse cycle 4 is only related to the conditions of the rinse cycle 3 and rinse cycle 4. In other words, additional conditions, such as but not limited to increased water temperature and agitation conditions, of an additional rinse cycle or cycles (e.g., rinse cycle 5 in FIG. 2) can be applied to reduce the detergent concentration even further. This may be important for example, for whose who may be hypoallergenic.

In accordance with one embodiment, at least one characteristic of a laundering process may be dynamically adjusted based at least in part upon a determined detergent concentration. Such dynamically adjustable characteristics may include but are not limited to the number of rinse or wash cycles performed, the duration of one or more rinse or wash cycles, the amount of water used within a given rinse cycle or a wash cycle or both, and the temperature of the wash fluid. In one embodiment, one or more sensors may be used to sense the detergent concentration at one or more points in time during the laundering process. The sensors may be optical or chemical sensors and may provide an indication of the detergent concentration to a controller which may in turn control operation of the wash and rinse cycles. For example, if the detergent concentration as measured from one cycle to another consecutive cycle does not appreciably change, a process controller may be configured to dynamically stop the associated laundering process before all preprogrammed cycles have been performed (e.g., after rinse cycle 3 in FIG. 2). In one embodiment, the slope of the detergent concentration versus time plot (e.g., such as illustrated in FIG. 1) may be monitored to allow even further control over the amount of water used and the cycle duration.

Determination of a detergent concentration within a given wash fluid may be performed in a number of ways. In accordance with one aspect of the present invention, it has been determined that a photometric analysis may be performed on the wash fluid during at least one cycle of an article laundering process to determine a relative or absolute detergent concentration. Since many commonly available detergents contain optical brighteners in the form of chromophores that contribute to ultraviolet absorbance and ultraviolet light induced fluorescence, it has been determined that a detergent concentration within a wash fluid may be ascertained based at least in part upon fluorescent properties of the wash fluid. The term "fluorescent properties" may refer to whether a substance such as wash fluid fluoresces as well as the respective emission and absorption spectra related to the substance. The use of the term "fluorescence" herein is intended to be inclusive and includes the emission properties with fluorescence lifetimes ranging from 0.02 nanoseconds to 100 seconds, preferably from 0.2 nanoseconds to 50 seconds, and more preferably from 0.25 nanoseconds to 10 seconds. As used herein, the term fluorescence is intended to include emission and luminescence.

In one embodiment at least one optical sensor may be configured within a laundering apparatus to expose the wash fluid to a first radiation and to detect a second radiation emitted by the wash fluid responsive to the first radiation. The sensor may include a radiation-emitting element such as a light emitting diode (LED) to emit radiation at a first wavelength or range of wavelengths, and a radiation-detecting element such as a photodiode to detect radiation emitted by the wash fluid in a second wavelength or range of wavelengths, which may but need not coincide with the emission wavelengths. In one embodiment, the sensor may emit radiation at wavelengths in the range of about 200 nm to about 500 nm. In another embodiment, the sensor may emit radiation at wavelengths in the range of about 220 nm to about 450 nm. In yet another embodiment, the sensor may emit radiation at wavelengths in the range of about 300 nm to about 410 nm. Additionally, the sensor may detect radiation at wavelengths in the range of about 300 nm to about 600 nm. In another embodiment, the sensor may detect radiation at wavelengths in the range of about 330 nm to about 630 nm. In yet another embodiment, the sensor may detect radiation at wavelengths in the range of about 350 nm to about 600 nm.

Figure 3:
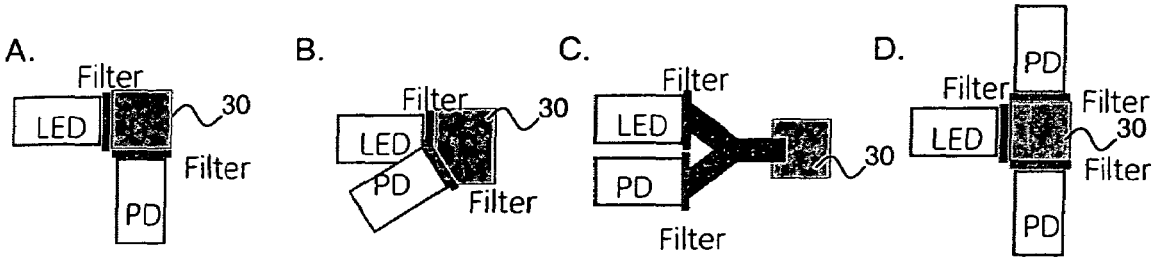
FIGS. 3A-3D illustrate block diagrams of an example sensor system in accordance with various embodiments.

FIGS. 3A-3D illustrate block diagrams of an example sensor system in accordance with various embodiments. In FIGS. 3A-3D, a radiation-emitting element, a radiation-detecting element and a fluid chamber are optically coupled to one another in different spatial relationship. More specifically, FIG. 3A illustrates a detergent sensor configuration in which the radiation-emitting element is positioned at a 90-degree angle with respect to the radiation-detecting element. FIG. 3B illustrates a small-degree illumination in which the radiation-emitting element is positioned at an acute angle (e.g. less than 90 degrees) with respect to the radiation-detecting element. FIG. 3C illustrates a waveguide illumination and signal collection configuration in which the radiation-emitting element is positioned parallel with respect to the radiation-detecting element. Lastly, FIG. 3D illustrates a multi-detector configuration in which multiple radiation-detecting elements are provided with emission filters A and B for different spectral ranges including scatter light detection, such as UV scatter light or any other wavelength emitted by a main emission peak of an LED or a side (much weaker) emission peak.

It should be noted that the various emitter-detector element orientations illustrated in FIGS. 3A-3D are intended to be illustrative and not exhaustive examples of sensor orientations that may be used in the design of the laundering system described herein. In one embodiment, the radiation-emitting elements may be an ultraviolet LED configured to excite fluorescence of detergent compositions contained within the fluid chamber (30), whereas the radiation-detecting elements may be a photodiode (PD) detector configured to measure a resulting optical signal responsive to the fluorescence. Examples of manufacturers and distributors of UV LEDs suitable for use herein as a radiation-emitting element are Nichia (Japan), Roithner Laser Technik (Germany), Marubeni-Sunnyvale (USA), Sensor Electronic Technology (USA), USA HORIBA Jobin Yvon (USA). Examples of manufacturers and distributors of photodiodes suitable for use as radiation-detecting elements are Hamamatsu (Japan), Perkin Elmer (USA), Roithner Laser Technik (Germany), International Radiation Detectors (USA), Texas Advanced Optoelectronic Solutions (USA). The fluid chamber (30) may represent a portion of a laundering apparatus such as a wash tub or flow cell in which samples of wash fluid may be dynamically analyzed during a wash or rinse cycle. Moreover, the radiation-detecting element of the detergent sensor can be configured as a single detector or an array of detecting elements.

As alluded to earlier, the radiation-emitting element of the sensor can operate in a steady state (e.g. continuous) or pulsed (e.g. periodic) modes. Operation in the pulsed mode provides several additional capabilities that include but are not limited to the increased optical output of the radiation-emitting element during the detergent concentration measurement cycle, capability to perform time-resolved fluorescence measurements, and extension of the operational lifetime of the radiation-emitting element.

Figure 4:
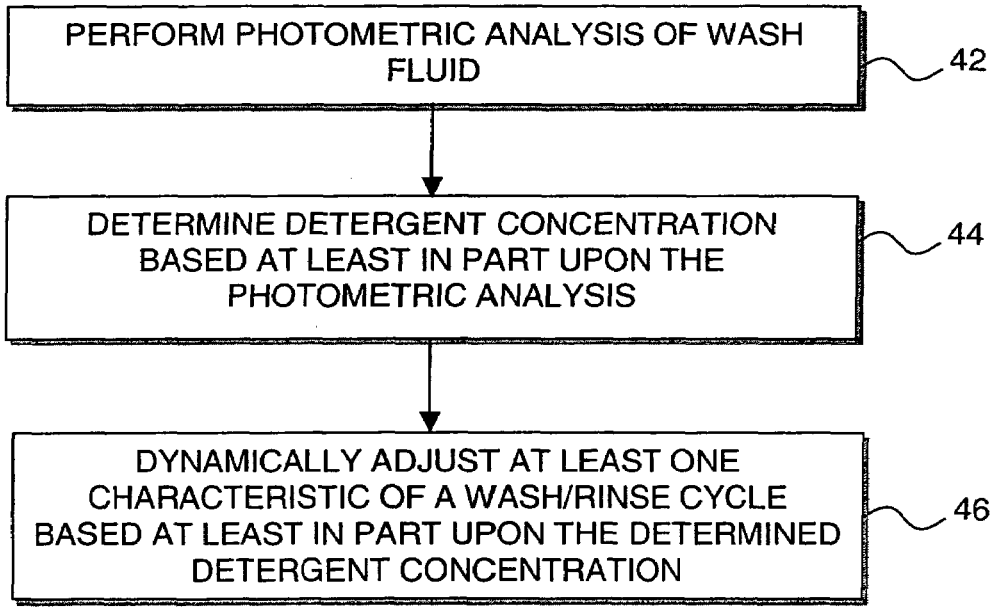
FIG. 4 is a block diagram illustrating a method of detecting detergent concentration within a wash fluid in accordance with one embodiment of the invention.

FIG. 4 is a block diagram illustrating a method of detecting detergent concentration within a wash fluid in accordance with one embodiment of the invention. As illustrated, a photometric analysis of a wash fluid is performed at block 42. In one embodiment, the photometric analysis may include determining fluorescent properties of the wash fluid. At block 44, a detergent concentration within the wash fluid is determined based at least in part upon the photometric analysis. Finally at block 46, at least one characteristic of a wash cycle, a rinse cycle or both are adjusted based at least in part upon the detergent concentration.

Figure 5:
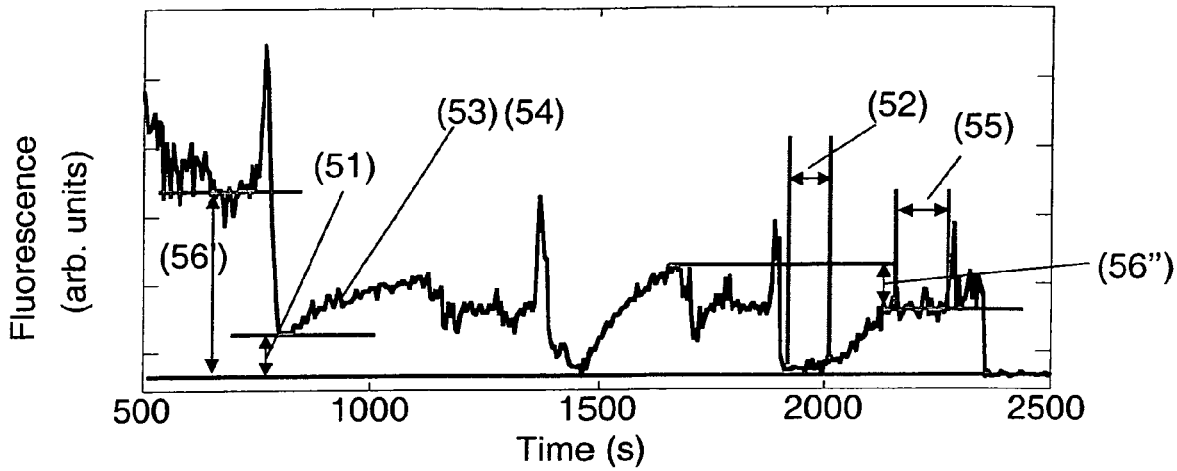
FIG. 5 illustrates various components of the dynamic signal pattern that may be analyzed as part of a process control algorithm for controlling a laundering process in accordance with one embodiment.

In one embodiment, a collection of descriptors may be used to characterize one or more components of a dynamic signal pattern generated by a detergent sensor in accordance with embodiments described herein. FIG. 5 illustrates various components of the dynamic signal pattern that may be analyzed as part of a process control algorithm for controlling a laundering process in accordance with one embodiment. In the illustrated embodiment, the signal pattern is representative of a fluorescence level of wash fluid as plotted against elapsed time within the laundering process. Each of the illustrated signal components has been determined to be useful in the determination of how a laundering process should be controlled.

With reference to FIG. 5, various components (51), (52) (53), (54), (55), (56) and (56') are illustrated. A first component (51) that may be used to influence control of a laundering process represents the amount of fluorescence detected after the end of the wash cycle. A second component (52) that may be used represents the incubation period (time delay) between the initiation of the rinse cycle and the appearance of the detergent-related signal. A third component (53) represents the slope of the increase of the signal. A fourth component (54) represents the derivative of the slope that determines the change in the rate of the signal increase. A fifth component (55) represents the duration of the period in the rinse cycle that is associated with the decreased rate of the change of the signal associated with the detergent concentration. Additionally, a sixth component (56') and (56") represents the magnitude of the signal associated with the detergent concentration.

In operation, a laundering apparatus may employ one or more user-selectable cleaning cycles that a user may select through e.g., an analog user interface such as a dial or knob or a digital user interface. The cleaning cycles may be time limited or performance limited. For example, an article laundering apparatus may be provided with a "normal" cycle, a "water-saving" cycle and a "hypoallergenic" cycle. In the "normal" cycle, the laundering apparatus may perform a cleaning process whereby the duration of the wash and rinse cycles are time-limited. In the "water-saving" cycle, the laundering apparatus may perform a hybrid cleaning process whereby the duration of the wash and rinse cycles are ultimately time-limited, but nonetheless may be stopped before the expiration of the scheduled cycle time if e.g., one or more components of a dynamic detergent concentration signal pattern indicates that the detergent concentration meets a specified criteria. In the "hypoallergenic" cycle, the cleaning cycle may continue independently of any predetermined time periods until e.g. the level of residual detergents falls below a very low specified amount. Additional approaches for further removal of residual detergent from the article may be employed. Such approaches may include rinsing with water at higher temperatures, rinsing with more agitation, with longer cycle time, with more water, with sonication, and others.

Figure 6:
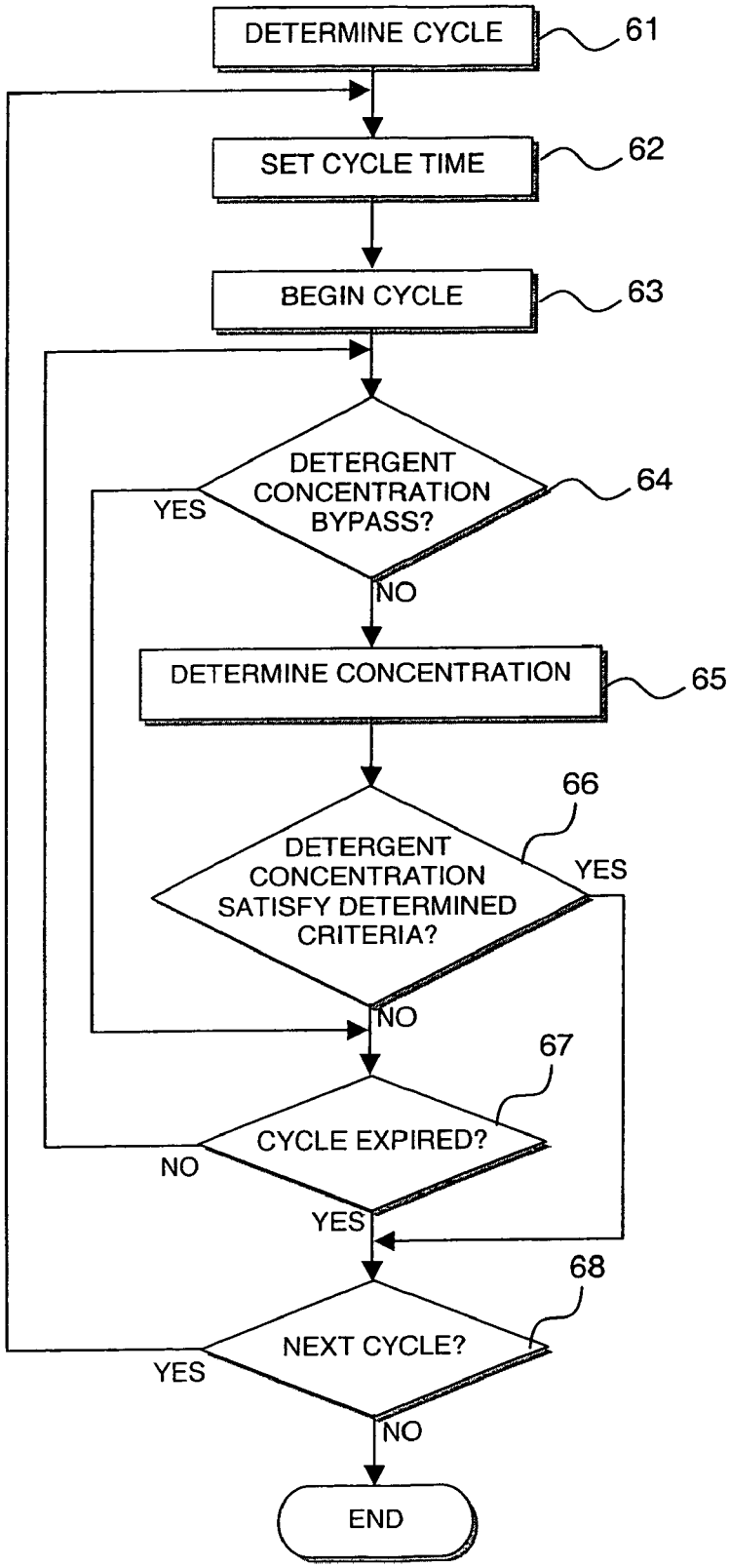
FIG. 6 is a block diagram illustrating an example operational flow of a controller for controlling a laundering process in accordance with one embodiment.

FIG. 6 is a block diagram illustrating an example operational flow of a controller for controlling a laundering process in accordance with one embodiment. With reference to FIG. 6, the process may begin at block 61 where the intended cleaning cycle is determined. Examples of such cleaning cycles may include "normal", "water-saving" and "hypoallergenic". Assuming a "water-saving" cycle is selected, one or more internal timers may be set at block 62 to limit the duration of the wash and rinse cycles. At block 63, the selected cycle may begin. Once the cycle begins, the system may make a determination as to whether the detergent being used is capable of fluorescing at block 64. This determination may be made based upon a user-provided input indicating the type of detergent being used, or may be made dynamically based on a field sampling of the detergent using a fluorescent detergent sensor. If it is determined that the detergent is not capable of fluorescing (e.g. as it may not contain any optical whiteners or brighteners), a detergent concentration determination bypass may occur forcing a more conventional time-based operation. In particular, the current cleaning cycle would continue until the predetermined time expired at block 67. At this point a determination might be made at block 68 as to whether any additional cleaning cycles remain or whether the cleaning process is complete. If one or more additional cleaning cycles remain, the process may loop back to block 62 where a timer for the next cycle may be set before continuing.

Referring back to block 64, if a determination is made to not bypass the detergent concentration determination cycle, one or more detergent sensors may in turn determine the detergent concentration at block 65. As was described above, the detergent concentration may be determined through a photometric or a fluorescent analysis of the wash fluid. Such analyses may be performed continuously or at discrete intervals. If the detergent concentration is determined to satisfy one or more determined criteria at block 66, the current cycle may be ended before its normally scheduled end and a further determination made at block 68 as to whether additional cleaning cycles remain. If the determined detergent concentration does not satisfy one or more determined criteria at block 66, a further determination may be made at block 67 as to whether the current cycle timer has expired. If the allocated time has expired, a determination is again made at block 68 as to whether any additional cycles remain. If so, the next cycle is initiated otherwise the process may come to an end.

Multivariate calibration methods (based on more than one response) offer an advantage of improved selectivity over univariate (one response) calibration methods. Multivariate calibration approaches permit more selective quantification of analyte (detergent) in complex samples (in presence of potential other fluorescent species such as lint, dirt, and others). Multivariate analysis has been widely used in chemistry. One aspect of the present invention is that multivariate analysis here is used to aid the dynamic control of the wash and rinse cycles. An exemplary method disclosed in this invention provides an array of photodetectors responsive to different spectral ranges of fluorescence and scatter from water solution. The sensor is provided that may include photodiode elements that are specifically designed to be optically responsive to different spectra ranges of fluorescence and scatter and applicable for multivariate analysis of fluorescence and scatter signals, and that would otherwise not be needed as part of a simple, but less accurate analysis. An example of such multiwavelength-response photodiode array is an array available from Texas Advanced Optoelectronic Solutions (USA).

Multivariate analysis methods include principal components analysis (PCA) that can be used to extract the desired descriptors from the dynamic data. PCA is a multivariate data analysis tool that projects the data set onto a subspace of lower dimensionality with removed co-linearity. PCA achieves this objective by explaining the variance of the data matrix X in terms of the weighted sums of the original variables with no significant loss of information. These weighted sums of the original variables are called principal components (PCs). Upon applying the PCA, the data matrix X is expressed as a linear combination of orthogonal vectors along the directions of the principal components:

$$X=t_1p^T{}_1+t_2p^T{}_2+\ldots+t_Ap^T{}_K+E \qquad \text{(Equation 1)}$$

where $t_i$ and $p_i$ are, respectively, the score and loading vectors, K is the number of principal components, E is a residual matrix that represents random error, and T is the transpose of the matrix. Prior to PCA, data was appropriately preprocessed. The preprocessing included auto scaling.

To ensure the quality of the dynamic data several statistical tools may be applied. These tools are multivariate control charts and multivariate contributions plots. Multivariate control charts use two statistical indicators of the PCA model, such as Hotelling's $T^2$ and Q values plotted as a function of combinatorial sample or time. The significant principal components of the PCA model are used to develop the $T^2$-chart and the remaining PCs contribute to the Q-chart. The sum of normalized squared scores, $T^2$ statistic, gives a measure of variation within the PCA model and determines statistically anomalous samples:

$$T^2 i = ti\lambda^{-1}ti^T = xiP\lambda^{-1}P^T xi^T \quad \text{(Equation 2)}$$

where ti is the ith row of Tk, the matrix of k scores vectors from the PCA model, $\lambda^{-1}$ is the diagonal matrix containing the inverse of the eigenvalues associated with the K eigenvectors (principal components) retained in the model, xi is the ith sample in X, and P is the matrix of K loadings vectors retained in the PCA model (where each vector is a column of P). The Q residual is the squared prediction error and describes how well the PCA model fits each sample. It is a measure of the amount of variation in each sample not captured by K principal components retained in the model:

$$Qi = ei\ ei^T = xi(I - Pk\ Pk^T)xi^T \quad \text{(Equation 3)}$$

where ei is the ith row of E, and I is the identity matrix of appropriate size (n×n).

Other multivariate analysis methods are also available, and may include, for example, pattern recognition techniques such as hierarchical cluster analysis (HCA), soft independent modeling of class analogies (SIMCA), and neural networks.

EXAMPLES

A spectral analysis of 13 detergents was performed in absorbance and fluorescence modes. Absorbance measurements were performed using detergent samples at 500 ppm on a benchtop diode array spectrophotometer (Hewlett Packard 8452A). Fluorescence measurements were performed using a 355 nm excitation. Fluorescence of samples (500 ppm of detergents) was measured using a portable fiber-optic spectrofluorometer (Ocean Optics ST2000). It was found that when excited at 355 nm, all 13 tested detergents produced detectable fluorescence. Based on emission spectra of the tested detergents, it was determined that the range from about 300 nm to about 600 nm should be applicable for determination of fluorescence from all detergents. Similarly, experimentally determined absorbance spectra (1-cm path length) of the detergents indicate the presence of enough ultraviolet absorbance for quantization of the detergents.

Figure 7:
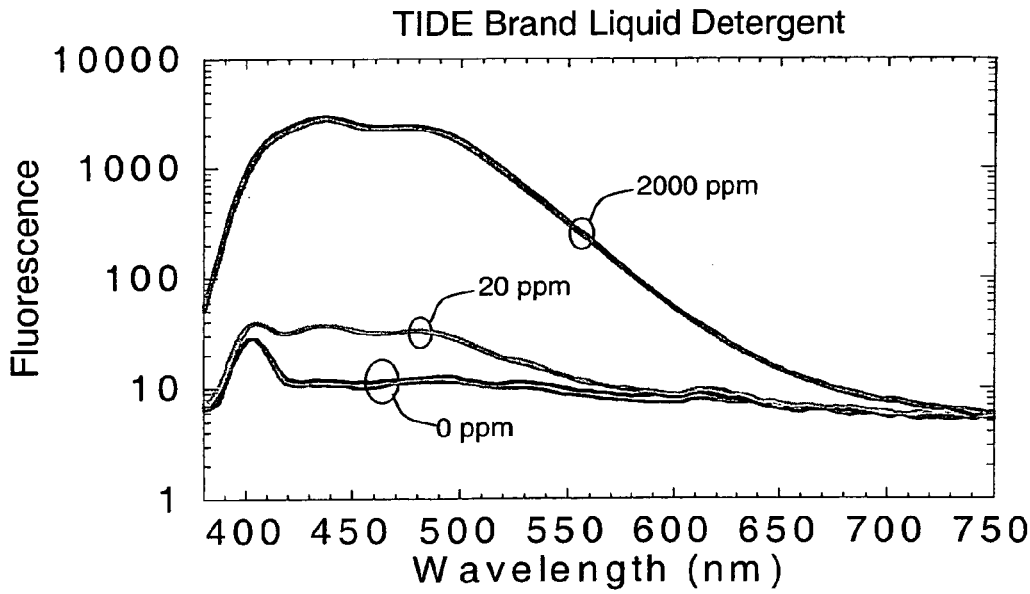
FIG. 7 and FIG. 8 illustrate fluorescence spectra of two detergents at 0, 20, and 2000 ppm concentrations.
Figure 8:
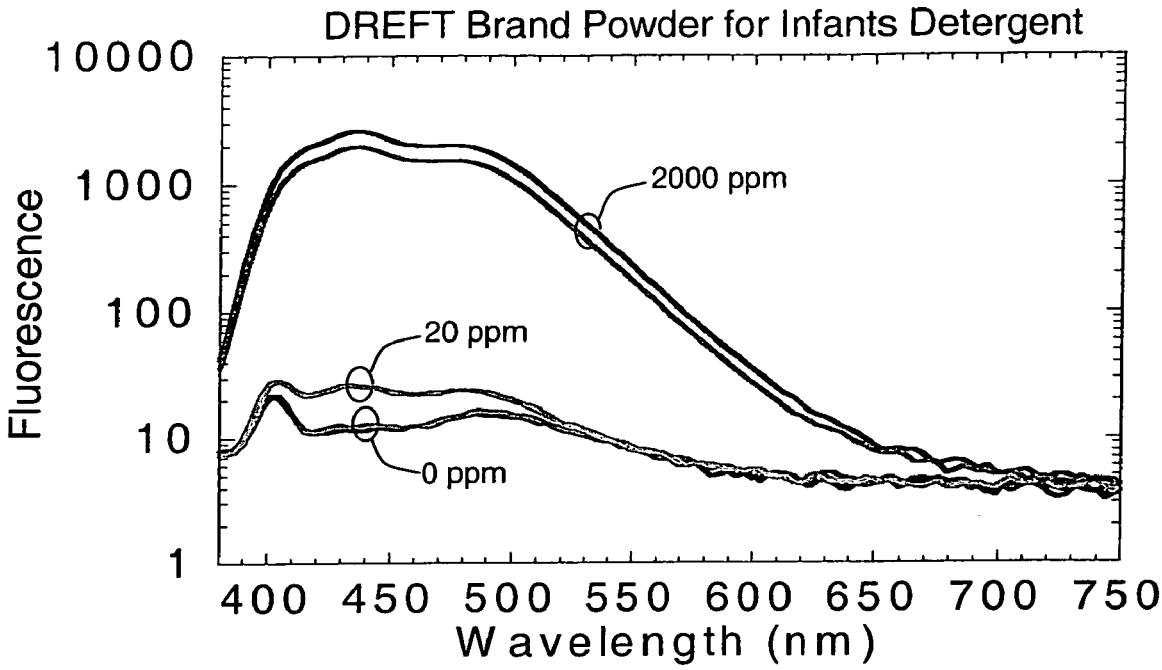

Analysis of multiple detergent concentrations was also performed to demonstrate the applicability of analytical fluorescence tools. FIG. 7 and FIG. 8 illustrate fluorescence spectra of two detergents at 0, 20, and 2000 ppm concentrations. FIG. 7 illustrates TIDE Liquid brand detergent and FIG. 8 illustrates DREFT Powder For Infants brand detergent (both available from Proctor and Gamble of Cincinnati, Ohio). Each measurement was performed twice.

Analysis of spectral properties of water samples was also performed during a wash and two rinse cycles of clothes in a PROFILE brand washing machine (available from General Electric of Fairfield, Conn.) using XTRA brand laundry detergent (available from Church & Dwight Co., Inc. Princeton, N.J.). FIG. 9 and FIG. 10 demonstrate fluorescence spectra of water samples from a wash and two rinse cycles when a certain amount of lint was settled (clear solution) and unsettled (light-scattering solution) (FIG. 9 and FIG. 10, respectively). Response curves produced by plotting fluorescence signals in the wash and two rinse cycles are illustrated in FIG. 11. This plot experimentally verified the disclosed concept illustrated schematically in FIG. 2.

Analysis of spectral properties of water samples was further performed during a wash and several rinse cycles of clothes in a vertical axis and horizontal axis washing machines. FIG. 12 demonstrates fluorescence spectra of water samples from a vertical axis washing machine. FIG. 13 demonstrates fluorescence spectra of water samples from a horizontal axis washing machine. These plots further experimentally verified the disclosed concept illustrated schematically in FIG. 2.

UV LEDs were obtained from recently available commercial sources and were emitting at 365 nm. A photodiode was obtained from a commercial source. A sensor system was built and measurements were performed with a complete system that included a 365-nm UV LED and a photodiode. FIG. 14 illustrates the resulting calibration curve obtained for detergent (TIDE HE) determinations.

An integrated array of photodiodes that are responsive to four spectral ranges of light was used to detect fluorescence from detergents in water. This response was provided by having optical bandpass filters in front of each photodiode element in the array. The spectral ranges covered blue, green and red light, as well as full spectrum of light from the light source.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A method for controlling an article laundering process comprising:

detecting a property of a wash fluid during at least one cycle of the article laundering process;

generating a plurality of components of a dynamic signal pattern representative of the detected property of the wash fluid during the at least one cycle of the article laundering process;

performing a multivariate analysis of the plurality of components of the dynamic signal pattern; and dynamically adjusting at least one characteristic of the article laundering process based on the multivariate analysis of the plurality of components of the dynamic signal pattern.

2. The method of claim 1, further comprising determining a concentration of a detergent within the wash fluid by performing a photometric analysis of the wash fluid during at least one cycle of the article laundering process.

3. The method of claim 2, wherein performing a photometric analysis of the wash fluid comprises identifying fluorescent properties of the wash fluid.

4. The method of claim 3, wherein identifying fluorescent properties of a wash fluid comprises:

exposing the wash fluid to first radiation; and detecting second radiation emitted by the wash fluid responsive to the first radiation.

5. The method of claim 4, wherein the first radiation comprises wavelengths ranging from about 200 nm to about 500 nm.

6. The method of claim 5, wherein the first radiation comprises wavelengths ranging from about 220 nm to about 450 nm.

7. The method of claim 5, wherein the first radiation comprises wavelengths ranging from about 300 nm to about 410 nm.

8. The method of claim 5, wherein the second radiation comprises wavelengths ranging from about 300 nm to about 650 nm.

9. The method of claim 5, wherein the second radiation comprises wavelengths ranging from about 330 nm to about 630 nm.

10. The method of claim 5, wherein the second radiation comprises wavelengths ranging from about 350 nm to about 600 nm.

11. The method of claim 1, wherein dynamically adjusting at least one characteristic of the article laundering process comprises adjusting a rinse cycle duration or wash cycle duration based at least in part upon the detected fluorescence and scatter properties of the wash fluid.

12. The method of claim 11, wherein dynamically adjusting at least one characteristic of the laundering process further comprises adjusting a water usage level within a rinse cycle.

13. The method of claim 12, wherein dynamically adjusting a water usage level during a rinse cycle comprises decreasing water usage during the rinse cycle.

14. The method of claim 12, wherein the water usage level is adjusted until the detergent concentration reaches a predetermined concentration level.

15. The method of claim 11, wherein dynamically adjusting at least one characteristic of the laundering process further comprises adjusting a rinse cycle time and a number of rinse cycles performed.

16. The method of claim 11, wherein dynamically adjusting at least one characteristic of the laundering process further comprises adjusting a rinse cycle time and an amount of water used in each rinse cycle.

17. A washing machine comprising:

a fluid chamber for containing a wash fluid;

a sensor coupled to the fluid chamber, the sensor detecting a property of the wash fluid during at least one cycle of an article laundering process; and a controller coupled to the sensor, wherein the controller is configured to generate a plurality of components of a dynamic signal pattern representative of the detected property of the wash fluid during the at least one cycle of the article laundering process, performs a multivariate analysis of the plurality of components of the dynamic signal pattern, and dynamically adjusts at least one characteristic of the article laundering process based on the multivariate analysis of the plurality of components of the dynamic signal pattern.

18. The washing machine of claim 17, wherein the sensor comprises an optical sensor optically coupled to the fluid chamber to detect the fluorescence and scatter properties of the wash fluid.

19. The washing machine of claim 18, wherein the optical sensor further comprises a radiation emitting element, a radiation detecting element, excitation optical filter, and emission optical filter, wherein the radiation emitting element is configured to emit radiation having wavelengths ranging from about 200 nm to about 500 nm, and the radiation detecting element is configured to detect radiation having wavelengths ranging from about 300 nm to about 650 nm.

20. The washing machine of claim 17, wherein the controller is further configured to adjust a wash cycle or a rinse cycle based at least in part upon the determined detergent concentration.

21. The washing machine of claim 20, wherein the controller is configured to adjust a wash cycle duration or a rinse cycle duration based at least in part upon the detected fluorescence level.

22. The washing machine of claim 20, wherein the controller is configured to adjust a water usage level within a rinse cycle.

23. The washing machine of claim 22, wherein the controller is configured to decrease the water usage level within the rinse cycle.

24. The washing machine of claim 17, wherein the controller is further configured to adjust a number of rinse cycles to be performed and a duration for each rinse cycle based at least in part upon the determined detergent concentration.

* * * * *

UNITED STATES PATENT AND TRADEMARK OFFICE

CERTIFICATE OF CORRECTION

PATENT NO. : 7,690,061 B2
APPLICATION NO. : 11/318297
DATED : April 6, 2010
INVENTOR(S) : Potyrailo et al.

It is certified that error appears in the above-identified patent and that said Letters Patent is hereby corrected as shown below:

In Column 7, Line 5, delete "(56) and (56′)" and insert -- (56′) and (56″) --, therefor.

Signed and Sealed this

First Day of June, 2010

David J. Kappos

David J. Kappos
*Director of the United States Patent and Trademark Office*